US011160732B2

(12) United States Patent
Ross

(10) Patent No.: US 11,160,732 B2
(45) Date of Patent: Nov. 2, 2021

(54) SPITTOON LID FOR DISPOSABLE CONTAINERS

(71) Applicant: Devon Ross, Gravette, AR (US)

(72) Inventor: Devon Ross, Gravette, AR (US)

( * ) Notice: Subject to any disclaimer, the term of this patent is extended or adjusted under 35 U.S.C. 154(b) by 16 days.

(21) Appl. No.: 16/829,017

(22) Filed: Mar. 25, 2020

(65) Prior Publication Data

US 2021/0100724 A1 Apr. 8, 2021

Related U.S. Application Data

(60) Provisional application No. 62/911,622, filed on Oct. 7, 2019.

(51) Int. Cl.
*A61J 19/02* (2006.01)

(52) U.S. Cl.
CPC ..... *A61J 19/02* (2013.01)

(58) Field of Classification Search
CPC ..... A61J 19/02
USPC ..... 4/258; 131/231; 220/501, 910; 126/32
See application file for complete search history.

(56) References Cited

U.S. PATENT DOCUMENTS 3,798,682 A * 3/1974 Harreld ..... A61J 19/00 4/271
4,261,486 A * 4/1981 Bush ..... B65D 47/0838 16/225
4,503,572 A * 3/1985 Dawson ..... A61J 19/00 220/521
4,513,525 A * 4/1985 Ward ..... A01K 97/05 43/55
4,807,769 A * 2/1989 Gach ..... B65D 47/103 215/235
4,838,448 A * 6/1989 Piano ..... B65D 51/18 220/257.2
4,885,809 A * 12/1989 Muchmore ..... A61J 19/02 4/259
5,251,542 A * 10/1993 Itoh ..... A47J 36/10 206/545
5,328,069 A * 7/1994 Cohanfard ..... A45F 3/16 215/228
5,379,787 A * 1/1995 Haines ..... A24F 19/00 131/231
6,471,085 B1 * 10/2002 Gallo ..... A47G 19/2272 206/459.5
6,718,563 B1 * 4/2004 Kreiensieck ..... A61J 19/00 4/258
6,932,231 B2 * 8/2005 Haynes ..... B65D 51/2807 206/217
7,448,510 B2 * 11/2008 Pavlopoulos ..... A47G 19/34 220/501
7,739,755 B2 * 6/2010 Taras ..... A61J 19/00 4/271
7,820,214 B2 * 10/2010 Groenke ..... A47G 19/02 426/115
7,874,449 B1 * 1/2011 Studee ..... A47G 19/02 220/502

(Continued)

*Primary Examiner* — Lori L Baker
(74) *Attorney, Agent, or Firm* — Michael Cameron; Jeff Cameron

(57) ABSTRACT

A removable lid or cap affixed to a disposable container such as a can or bottle in order to repurpose said container into a disposable spittoon. A tube extends from the lid or cap to the interior of the container to prevent spills. The lid or cap attaches to the container, including tabs or collar for interfacing with a can or bottle, respectively.

17 Claims, 5 Drawing Sheets

(56) References Cited

U.S. PATENT DOCUMENTS

| | | | | |
|---|---|---|---|---|
| 8,365,960 | B1 * | 2/2013 | Kalaouze | B65D 81/3211 222/145.5 |
| 8,459,491 | B2 * | 6/2013 | Savenok | B65D 51/1611 220/592.17 |
| 8,574,647 | B1 * | 11/2013 | Gunderson | B65D 25/04 426/115 |
| 8,863,546 | B2 * | 10/2014 | Oberweis | F25D 3/14 62/384 |
| 10,052,265 | B1 * | 8/2018 | Duffer | A61L 2/23 |
| 10,857,071 | B1 * | 12/2020 | McClure | B65D 47/40 |
| 2002/0020008 | A1 * | 2/2002 | Nguyen | A61J 19/02 4/258 |
| 2004/0200844 | A1 * | 10/2004 | Watzke | B65D 81/262 220/501 |
| 2004/0200845 | A1 * | 10/2004 | Watzke | B65D 81/32 220/501 |
| 2005/0247715 | A1 * | 11/2005 | Ellsworth | B01L 3/50215 220/501 |
| 2006/0196193 | A1 * | 9/2006 | Byrne | B01L 9/52 62/62 |
| 2010/0206766 | A1 * | 8/2010 | Warman | B65D 83/049 206/538 |
| 2012/0248120 | A1 * | 10/2012 | Yin | B65D 43/021 220/501 |
| 2015/0305571 | A1 * | 10/2015 | Hanson | B65D 25/04 220/501 |
| 2020/0138674 | A1 * | 5/2020 | Freeman | A61J 19/02 |

* cited by examiner

SPITTOON LID FOR DISPOSABLE CONTAINERS

CROSS REFERENCE TO RELATED APPLICATION

This application claims the benefit of U.S. Provisional Application No. 62/911,622, filed Oct. 7, 2019, the contents of which are incorporated herein.

TECHNICAL FIELD

The present invention relates to spittoons, lids and coverings.

BACKGROUND OF THE INVENTION

A spittoon is a device for receiving spittle, generally associated with smokeless tobacco use. It is common practice to repurpose an empty disposable container, can, cup, or bottle (collectively referred to as a "container") for use as a spittoon, however because these devices are not intended to be used as such there is the risk of spillage and other inconveniences, these resulting from aspects of said repurposed devices such as overly narrow, overly wide, or non-resealable openings.

SUMMARY OF THE INVENTION

The present invention is a removeable lid that can be affixed to a disposable container in order to repurpose said container as a spittoon. The lid changes the geometry of the opening of said container to improve liquid retention if said container is placed on its side or inverted, as well as during vigorous activity such as shaking. In one embodiment, said removeable lid affixes to a disposable can such as a soda can and comprises a tube or funnel extending through the opening of the original can and connecting the interior of the can to the opening of the lid, said lid opening for receiving spittle. Said tube or funnel comprises a flexible ring of material positioned such that it is wedged between the outer surface of said tube and the inner edge of the opening of said original can, said flexible ring of material acting as a seal to prevent liquid from the interior of said can from reaching the enclosed volume between the lid and the upper surface of said can.

In another embodiment, said removeable lid affixes to a disposable bottle and comprises a tube or funnel extending through the opening of the bottle and connecting the interior of said bottle to the opening of the lid, said lid opening for receiving spittle, the removeable lid being coupled to the disposable bottle using a push on collard coupling.

To those skilled in the art to which this invention relates, many changes in construction and widely differing embodiments and applications of the invention will suggest themselves without departing from the scope of the invention as defined herein. The disclosures and the descriptions herein are purely illustrative and are not intended to be in any sense limiting.

BRIEF DESCRIPTION OF THE DRAWINGS

For a better understanding of the present invention including the features, advantages and embodiments, reference is made to the following detailed description along with accompanying Figures wherein.

DETAILED DESCRIPTION OF A PREFERRED EMBODIMENT

While the making and using of the disclosed embodiments of the present invention is discussed in detail below, it should be appreciated that the present invention provides many applicable inventive concepts which can be embodied in a wide variety of specific contexts.

Some features of the preferred embodiments shown and discussed may be simplified or exaggerated for illustrating the principles of the invention.

The present invention is a removeable lid that can be affixed to a disposable container in order to repurpose said container as a spittoon. The lid changes the geometry of the opening of said container to improve liquid retention if said container is placed on its side or inverted, as well as during vigorous activity such as shaking.

Figure 1:
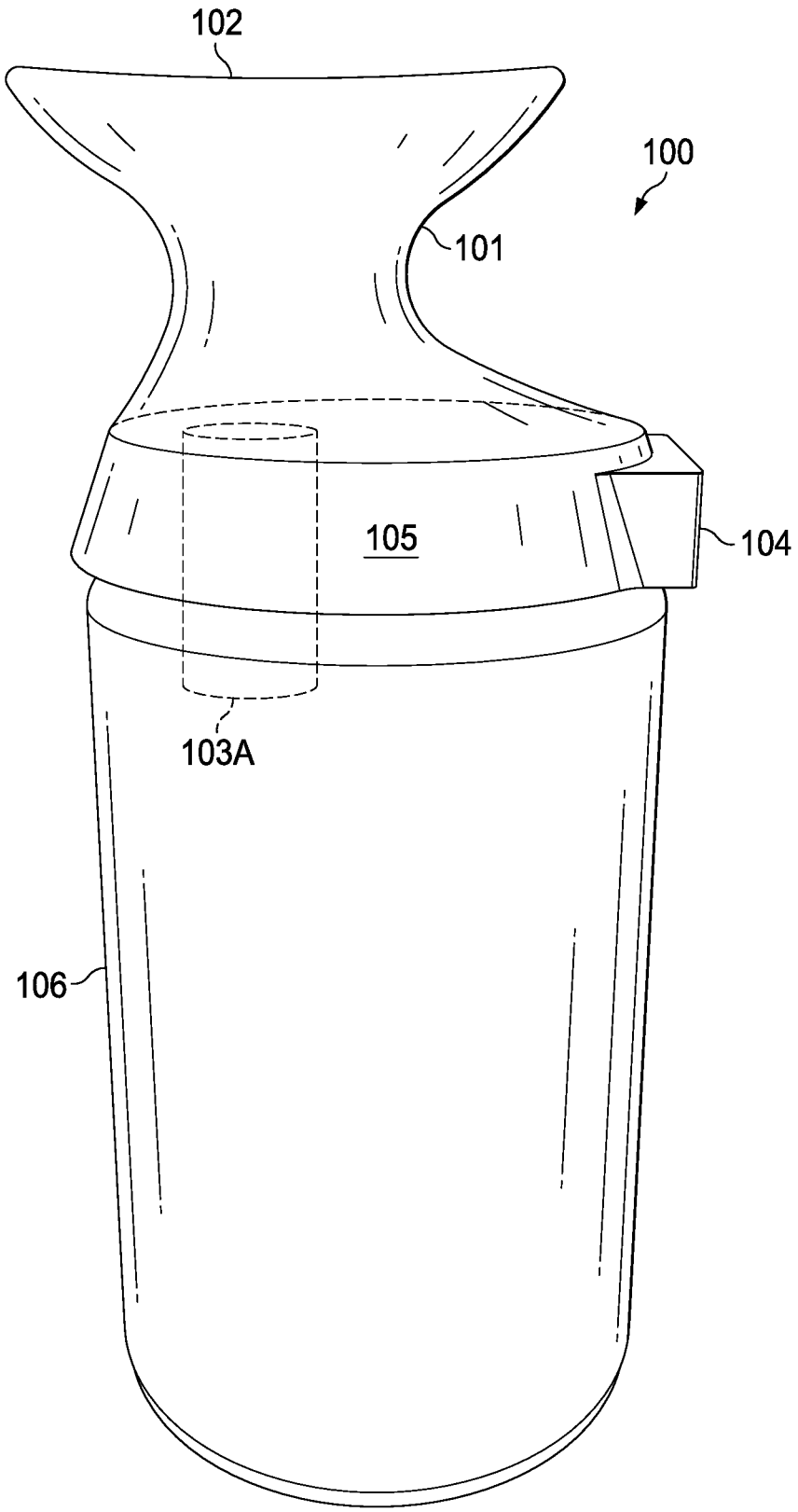
FIG. 1 is a side view of a first embodiment of the invention coupled to a bottle.

FIG. 1 is a side view of a first embodiment of the invention, comprising removable lid 100 coupled to a bottle 106. Referring to FIG. 1, in a first embodiment, the invention is a removeable lid 100 having an upper portion 101 being a closed sheet hyperboloid, generally known as an hourglass shape with an open upper end 102, and a lower portion 105, the lower portion 105 dimensioned as a hollow, thin-walled cylinder having one end substantially closed, said substantially closed end defining upper and lower surfaces, said substantially closed end having a thin-walled cylindrical tube 103A extending therethrough. As seen in FIG. 1, the lower portion 105 comprises a thin-walled hollow cylinder having its longitudinal axis oriented vertically and being substantially closed on its upper end. The invention further comprises a removal tab 104 integrated into lower portion 105 extending laterally from said lid 100, said removal tab 104 providing leverage for the removal of said removable lid 100 from said disposable container by applying upward pressure thereto. The removeable lid 100 is comprised of a resilient, pliable material, such as pliable plastic, rubber or silicone.

As noted, said removeable lid 100 further comprises a thin-walled cylindrical tube 103A which, when said lid is affixed on a disposable can, extends from an offset opening on the upper surface of said removable lid 100 through the opening of said disposable can to a point well inside the interior of said can, said tube 103A thus connecting the interior of said can to the opening in the upper surface of said removable lid 100, said removable lid 100 opening for receiving spittle.

Figure 2:
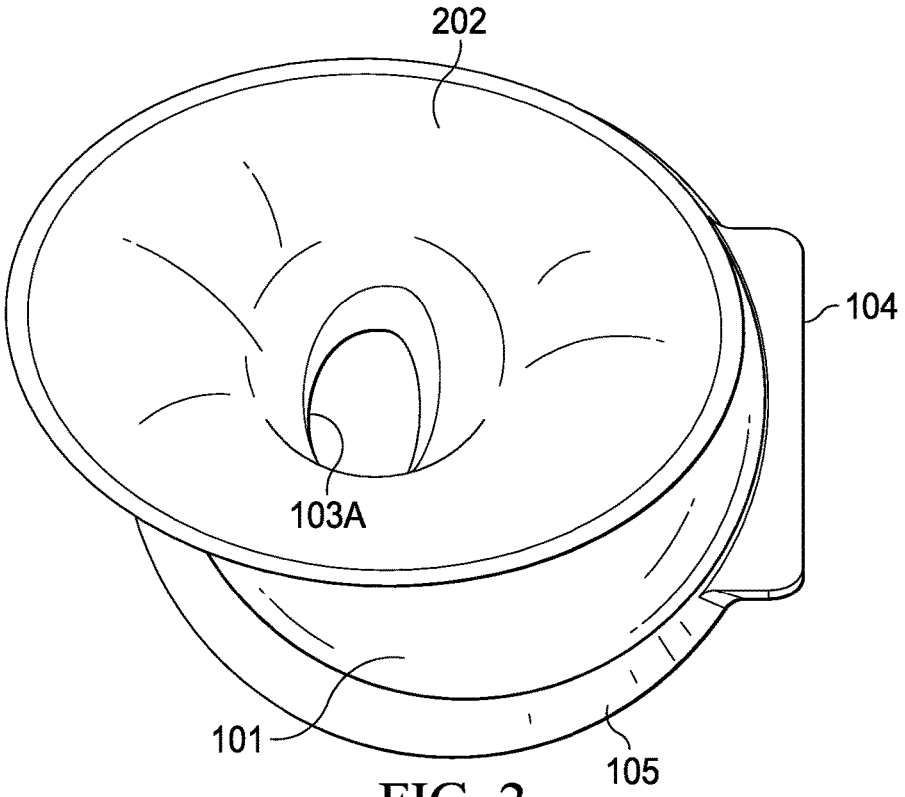
FIG. 2 is a perspective view of the first embodiment of the invention.

FIG. 2 is a perspective view of the first embodiment of the invention 100 showing the interior surface 202 of the upper portion 101 of the invention, removal tab 104 and thin-walled cylindrical tube 103A extending from the inner surface of the lower portion 100 of the lid 100.

Figure 3:
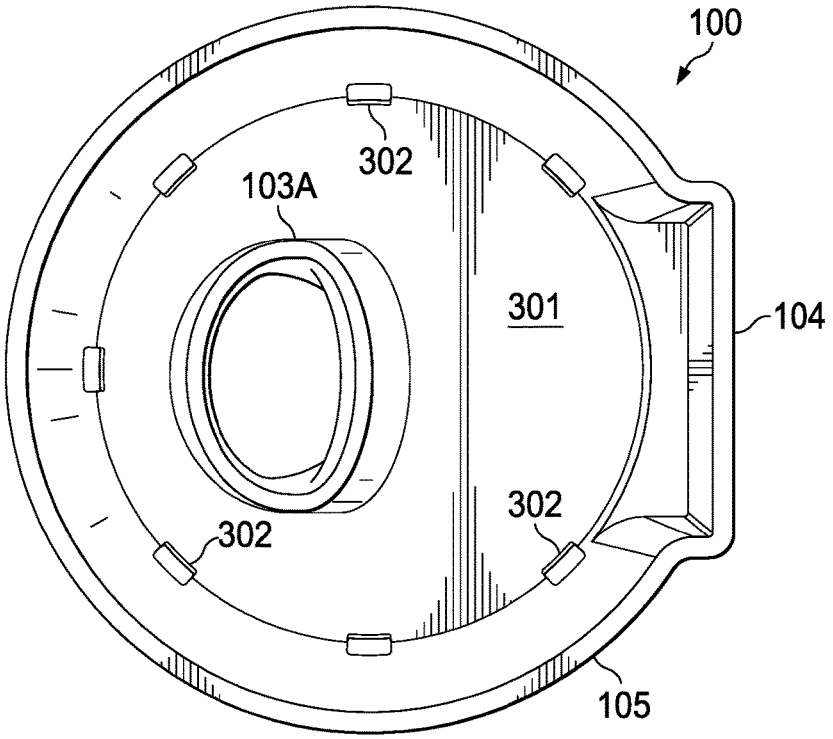
FIG. 3 is a bottom view of a first embodiment of the invention.

Referring to FIG. 3, said removable lid 100 has within the inner surface 301 of the lower portion 105 a plurality of regularly-spaced tabs 302 positioned around the circumference of the lower inner surface and extending inward, such tabs being made of plastic and being dimensioned such that they admit and removably secure said removable lid to the rim of a soda or beer can via elastic deformation of said tabs.

Figure 4:
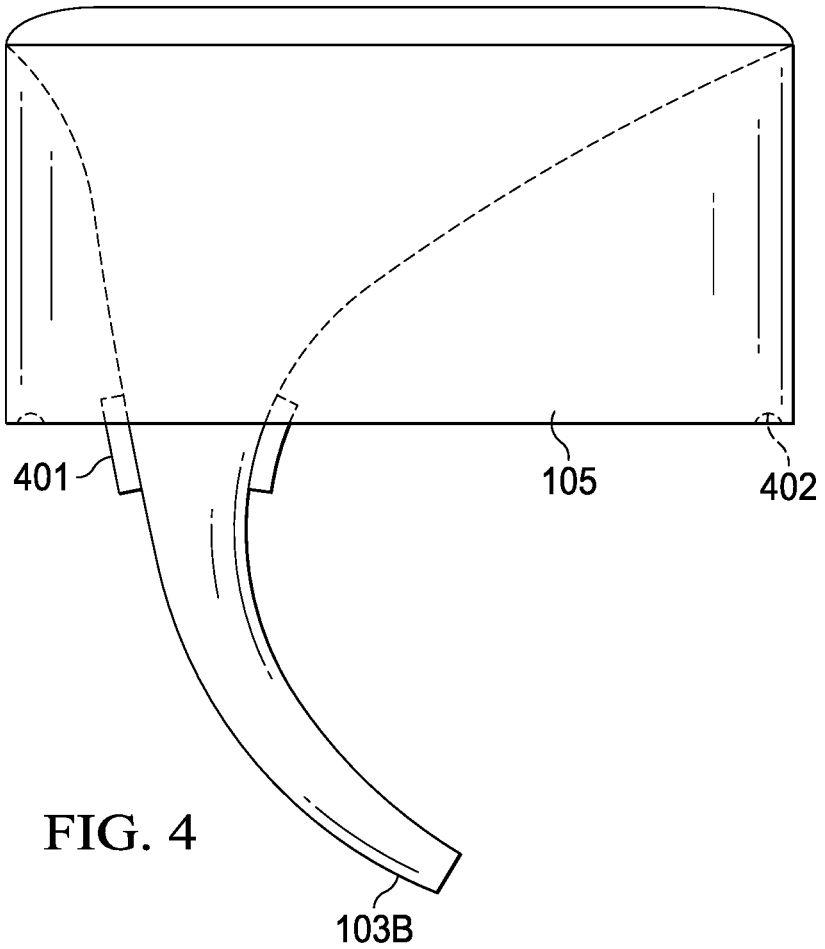
FIG. 4 is a side view of the lower portion of the first embodiment of the invention.

In a further aspect of the first embodiment, as seen in FIG. 4, said removeable lid comprises on its lower portion 105 a groove 402 extending upward into the thin cylindrical wall and dimensioned to be removably securable to the top rim of a disposable soda or beer can 301 via elastic deformation of said groove to admit said can rim. Further, as seen in FIG. 4, in a further aspect of the first embodiment, tube 103B which extends through the upper surface of said removable lid 100, flares open into a funnel.

In another aspect of the first embodiment, referring to FIG. 4, said removeable lid 100 further comprises a seal 401, said seal 401 being made of a flexible, impermeable material such as rubber or silicone and being positioned in an annulus around said tube or funnel such that, when said lid is affixed to a can, said seal 401 is firmly wedged between the outer surface of said tube 103A or 103B and the inner edge of the opening of said can, said seal 401 acting to prevent liquid from the interior of said can from reaching the enclosed volume between the lid and the upper surface of said can.

Figure 5:
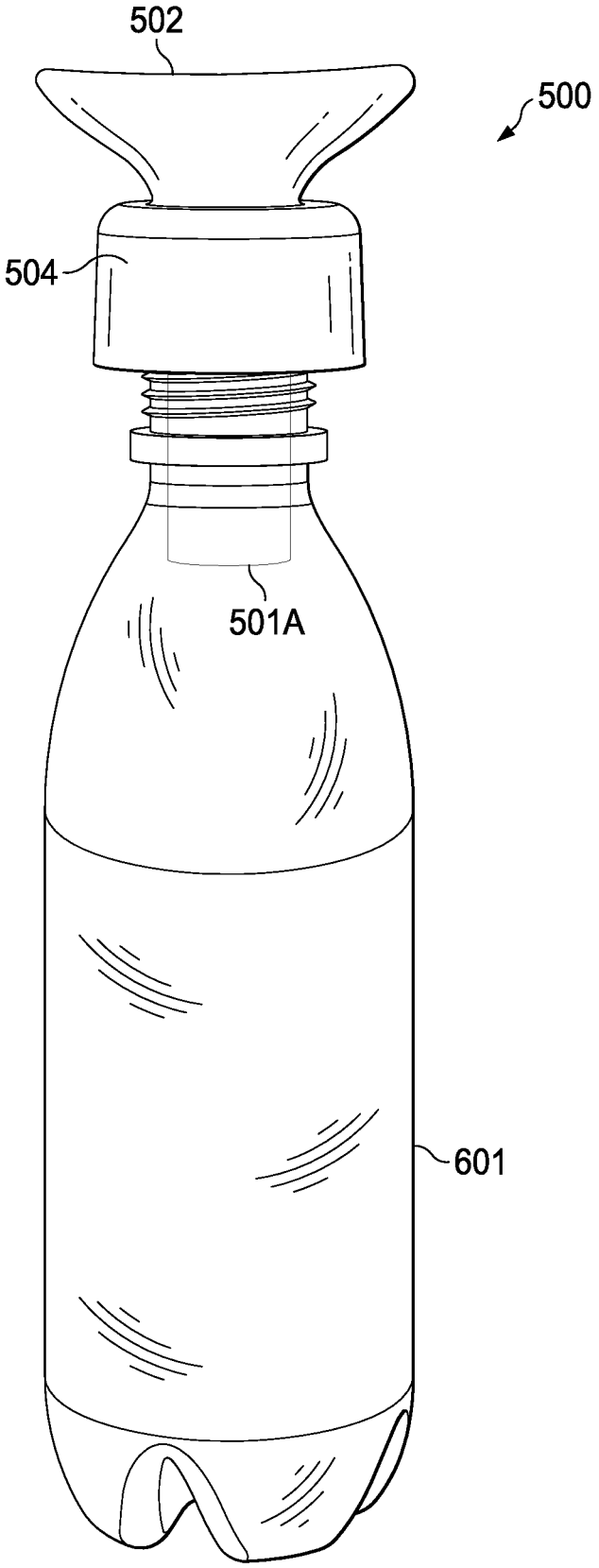
FIG. 5 is a side view of the second embodiment of the invention coupled to a bottle.

FIG. 5 is a side view of the second embodiment of the invention coupled to a bottle. As seen therein, the invention is a removeable cap 500 which affixes to a disposable plastic bottle 601 such as a water bottle and comprises a tube 501A extending through the opening of the bottle and connecting the interior of said bottle 601 to the opening of the removeable cap 500, said removeable cap 500 opening for receiving spittle.

Figure 6:
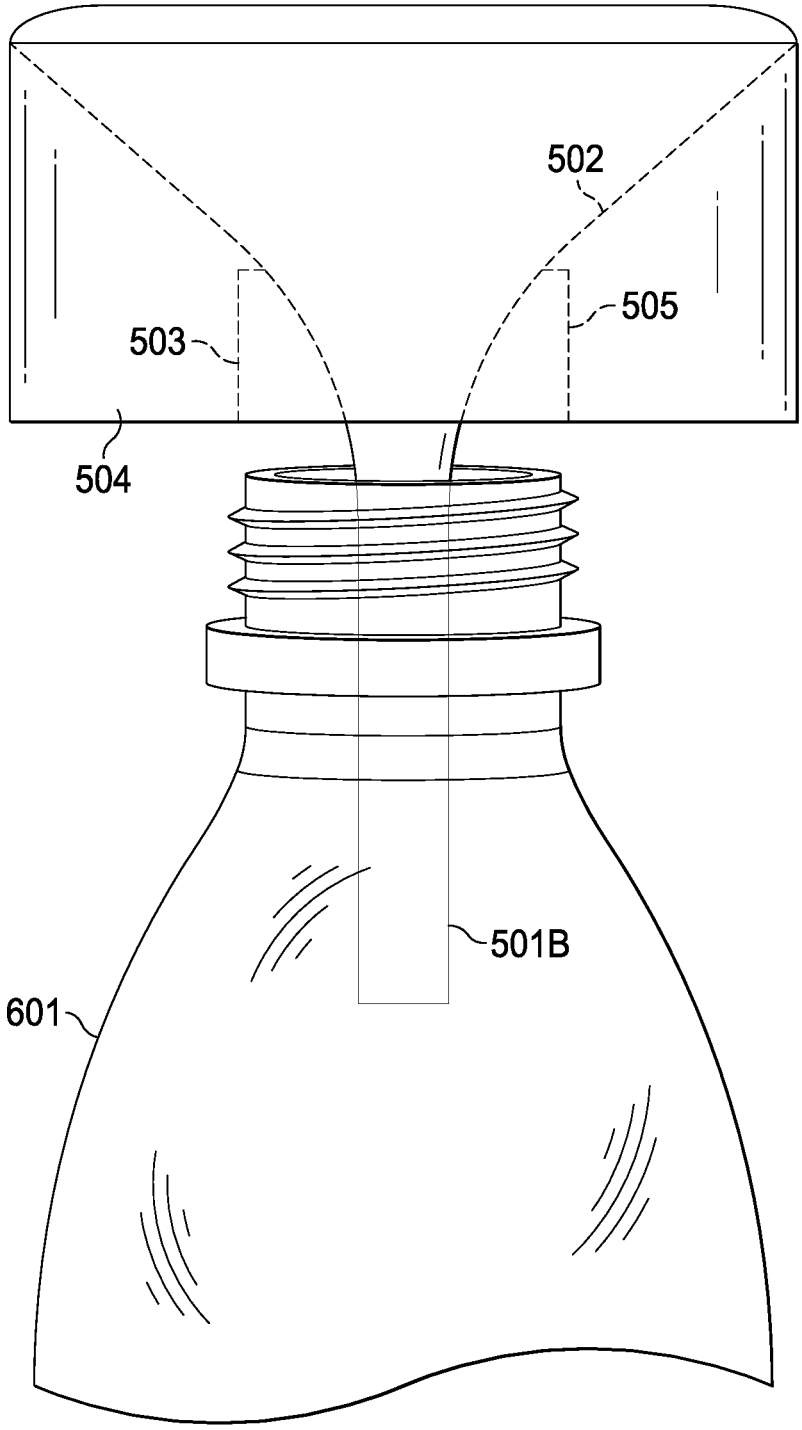
FIG. 6 is a side cutaway view of the second embodiment of the invention coupled to a bottle using snap on coupling.

Said removeable cap 500 comprises upper portion 502 and lower portion 504, lower portion 504 comprising an outer and inner coaxial cylindrical tube 503, 504. In an aspect of the n one embodiment, the inner coaxial cylindrical tube 503 comprises snap on collar 505 on its interior surface such that said removeable cap 500 can be pushed on to a disposable bottle in order to securely affix said removeable cap 500 to said bottle; the inner coaxial cylindrical tube 503 being a thin-walled cylindrical tube which, when said cap is affixed on a disposable bottle, extends from an opening on the upper surface of said lower portion of the removeable cap 500 through the opening of said disposable bottle to a point well inside the interior of said bottle, said tube 501A, 501B thus connecting the interior of said bottle to the opening in the upper surface of said lower portion 504 of removable cap 500, said removable cap 500 opening for receiving spittle. Referring to FIG. 6, an aspect of the second embodiment said tube 501B flares outward into a funnel shape.

Figure 7:
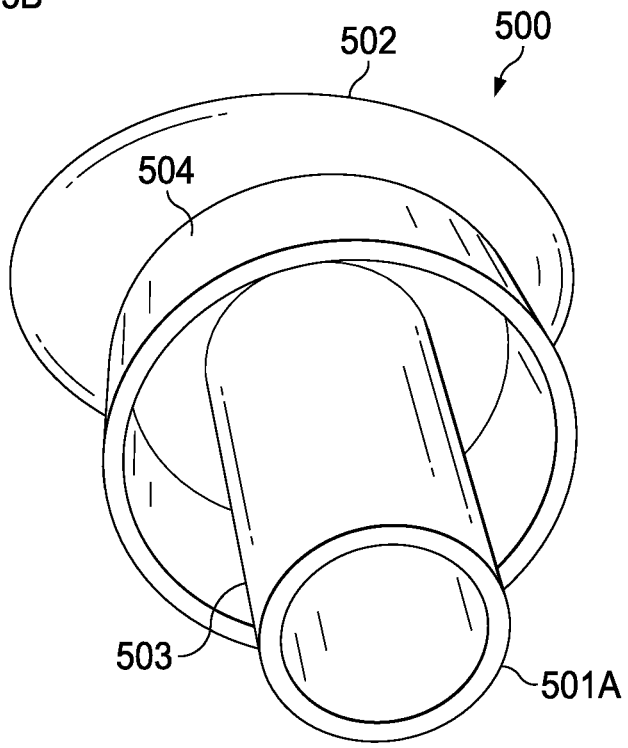
FIG. 7 is a perspective view of a second embodiment of the invention.

FIG. 7 is a perspective view of a second embodiment of the invention. Said removeable cap 500 comprises upper portion 502 and lower portion 504, lower portion 504 comprising an outer and inner coaxial cylindrical tube 503, 504. Upper portion comprises generally a closed sheet hyperboloid shape. The removable cap 500 can be seen as comprising an upper portion 502 and a lower portion 504, the lower portion 502 being a hollow, thin-walled cylinder having one end substantially closed, said substantially closed end defining upper and lower surfaces, said substantially closed end having a thin-walled cylindrical tube extending downward therethrough in an coaxial alignment therewith. The removable cap further comprises a thin-walled cylinder coaxial with said tube, said tube having a smaller diameter and being located inside of said cylinder, said cylinder comprising on its inner surface a snap on mechanism operable to be snapped onto the outer surface of the opening of a disposable bottle such that said lid can be secured by pushing it onto said bottle opening.

The invention is a removable lid or cap which can be affixed to a disposable container such as a can or bottle in order to repurpose said container into a disposable spittoon. The invention comprises a tube which extends from the lid to the interior of the container to prevent spills. The invention further comprises a way to attach the lid to the container, including tabs or collar for interfacing with a can or bottle, respectively.

The embodiments shown and described above are only exemplary. Even though numerous characteristics and advantages of the present invention have been set forth in the foregoing description, the disclosure is illustrative only and changes may be made within the principles of the invention to the full extent indicated by the broad general meaning of the terms used herein. Various alterations, modifications and substitutions can be made to the disclosed invention and the system that implements the present invention without departing in any way from the spirit and scope of the invention.

What is claimed is:

1. A lid, comprising:

an upper portion, and a lower portion, wherein said upper portion comprises a closed sheet hyperboloid and the lower portion is dimensioned as a cylinder having one end substantially closed, said substantially closed end defining upper and lower surfaces, said closed end having integrated thereto a tube extending from an opening therethrough from the upper portion thereof, the lid or cap being dimension to be affixed to a disposable container in order to repurpose said container as a spittoon.

2. The lid claim 1, wherein the tube is a thin-walled cylindrical tube extending from an offset opening through the upper portion thereof.

3. The lid of claim 1, in which said tube extends downward from an opening in the substantially closed end surface and flares outward into a funnel shape.

4. The lid of claim 1, in which said removeable lid further comprises a plurality of tabs extending inward from the inner circumference of the interior of the lower portion, said tabs being dimensioned to receive and removably secure the upper rim of a disposable soda can via plastic deformation of said tabs.

5. The lid of claim 1 in which said removeable lid further comprises a removal tab integrated into and extending laterally from said lid, said removal tab being made of plastic and being dimensioned such that it admits and removably secures said removable lid to the rim of a soda or beer can via elastic deformation of said removal tab.

6. The lid of claim 1 in which said tube further comprises on its outer surface a seal made of a compressible, impermeable material such as rubber.

7. The lid of claim 1, in combination with a disposable container.

8. The lid of claim 7, wherein the disposable container is a disposable plastic bottle.

9. A removable cap, comprising:

an upper portion and a lower portion, the lower portion being a cylinder having one end substantially closed, said substantially closed end defining upper and lower surfaces, said substantially closed end having a cylindrical tube extending downward therethrough in coaxial alignment therewith.

10. The removable cap of claim 9, further comprising a thin-walled cylinder in coaxial alignment with said tube, said tube having a smaller diameter and being located inside of said cylinder, said cylinder comprising on its inner surface a snap on collar corresponding to the outer surface of the opening of a disposable bottle such that said lid can be secured by pushing it onto said bottle opening.

11. The removable cap of claim 10, in combination with a disposable container.

12. The removable cap of claim 11, wherein the disposable container is a disposable plastic bottle.

13. A lid for use as part of a spittoon, comprising:

an upper portion and a lower portion, the lower portion being a cylinder having one end substantially closed, said substantially closed end defining upper and lower surfaces, said substantially closed end having a cylindrical tube extending downward therethrough in coaxial alignment therewith.

14. The lid of claim 13, wherein said upper portion comprises a closed sheet hyperboloid and the lower portion is dimensioned as a cylinder having one end substantially closed, said substantially closed end defining upper and lower surfaces, said closed end having integrated thereto a tube extending from an opening therethrough from the upper portion thereof wherein the closed sheet hyperboloid has an upper opening for receiving spittle.

15. The lid of claim 14, wherein the tube extends downward from an opening in the substantially closed end surface and flares outward into a funnel shape.

16. The lid of claim 13, in combination with a disposable container.

17. The lid of claim 13, wherein the disposable container is disposable plastic bottle or soda or beer can.

* * * * *